United States Patent [19]

Hamel

[11] 4,067,507

[45] Jan. 10, 1978

[54] FILAMENT-WINDING MECHANISM

[75] Inventor: Edmund Hamel, Romanshorn, Switzerland

[73] Assignee: Evolution S.A., Rorschach, Switzerland

[21] Appl. No.: 660,509

[22] Filed: Feb. 23, 1976

[30] Foreign Application Priority Data

Feb. 24, 1975 Germany ..... 2507891

[51] Int. Cl.[2] ..... B65H 54/42

[52] U.S. Cl. ..... 242/18 DD

[58] Field of Search ..... 242/18 DD, 18 A, 47, 242/35.5 A, 66

[56] References Cited

U.S. PATENT DOCUMENTS

| | | | |
|---|---|---|---|
| 3,507,453 | 4/1970 | Scragg et al. | 242/18 A |
| 3,572,597 | 3/1971 | Parker et al. | 242/18 A |

FOREIGN PATENT DOCUMENTS

| | | | |
|---|---|---|---|
| 740,724 | 11/1932 | France | 242/66 |
| 715,469 | 9/1954 | United Kingdom | 242/66 |
| 721,951 | 1/1955 | United Kingdom | 242/18 DD |

*Primary Examiner*—Stanley N. Gilreath
*Attorney, Agent, or Firm*—Karl F. Ross

[57] ABSTRACT

A take-up spool for winding a filament under tension, e.g. preparatorily to its passage through a heating tunnel or other treatment zone, has a core bounded by a pair of cheeks which bracket two parallel rollers freely supporting the core through the filament body being wound thereon. At least one of the rollers is driven to rotate the spool; the other roller may be transversely movable to increase the gap between the rollers for letting the loaded spool drop onto a conveyor or into a receptacle.

3 Claims, 9 Drawing Figures

FILAMENT-WINDING MECHANISM

FIELD OF THE INVENTION

My present invention relates to a mechanism for winding threads, yarns and other filaments on spools to form packages in which the filament can be subjected to further treatment.

BACKGROUND OF THE INVENTION

In conventional thread-winding devices, a take-up spool is carried on a mandrel which is progressively displaceable to maintain the filament body of increasing diameter in continuous contact with a driving roller. This mode of mounting is inconvenient since it requires the mandrel to be extracted preparatorily to any further handling of the package.

OBJECTS OF THE INVENTION

It is therefore an object of my present invention to provide a mechanism of the above-mentioned type dispensing with the need for a supporting mandrel for the spool on which the filament is to be wound.

It is another object of my invention to provide means in such a mechanism enabling the filament to be wound in close convolutions and without crossover points.

SUMMARY OF THE INVENTION

A winding mechanism according to my present invention, designed to handle one or more spools each having a core bounded by a pair of cheeks, comprises a pair of parallel rollers with substantially horizontal axes advantageously carried on respective mounting shafts. These rollers are separated, at least in a winding position, by a distance less than the diameter of the core so as to support the spool from below. The length of the rollers is almost equal to the axial spacing of the spool cheeks, so that their coplanar end faces fit closely between these cheeks for holding the spool in an axially fixed position.

At least one of the rollers is driven for rotary entrainment of the spool by frictional contact with its core through the filament body progressively building up thereon. If necessary, the spool may be weighted to increase the contact pressure.

According to a more particular feature of my invention, the two roller mountings are relatively displaceable to increase their distance beyond the diameter of the loaded spool for letting the completed package drop onto a receiving surface, e.g. the bottom of a receptacle or a conveyor leading to a treatment station such as a heating zone for thermal fixation. For this purpose, I prefer to make one of the rollers — advantageously a non-driven one — laterally movable, as by mounting it on a swingable arm which may be locked in a working position by a detent releasable by suitable sensing means, such as a thread meter or a package feeler, when the amount of filament wound on the spool reaches a predetermined magnitude.

The precise axial positioning of the spool during the winding process makes it possible to lay the filament in close convolutions by letting that filament pass through a frictional guide on its way to the spool, this guide being reciprocable in synchronism with the roller device.

In an advantageous embodiment, each shaft carries several aligned rollers for simultaneously winding two or more packages.

BRIEF DESCRIPTION OF THE DRAWING

The above and other features of my present invention will become more readily apparent from the following detailed description given with reference to the accompanying drawing in which.

SPECIFIC DESCRIPTION

Figure 1:
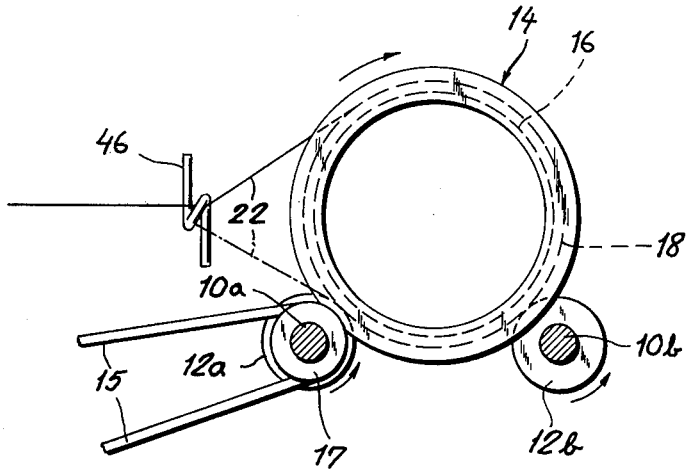
FIG. 1 is an end view of a mechanism according to my present invention.
Figure 2:
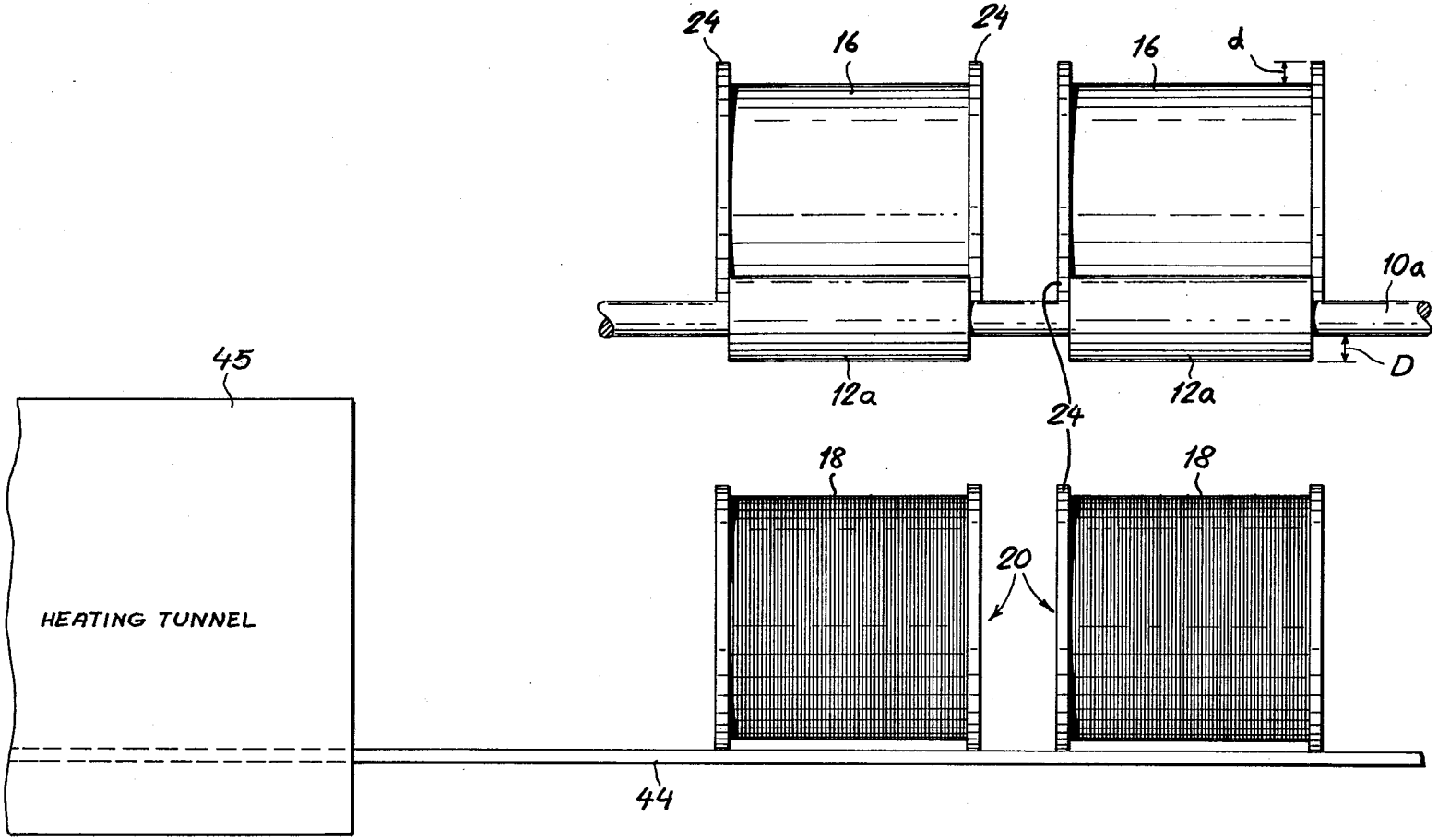
FIG. 2 is a side view of the mechanism illustrated in FIG. 1.

In FIGS. 1 and 2 I have illustrated a mechanism according to my invention for winding thread 22 from nonillustrated sources, such as top-drawing or double-twist spindles, on several spools 14 (only two shown), each spool being supported by a pair of drive rollers **12*a* and 12*b*. Each spool has a tubular core 16 bounded by a pair of cheeks 24. The rollers 12*a* and 12*b* are carried on a pair of parallel, horizontal mounting shafts 10*a* and 10*b*, respectively, and are separated by a distance less than the diameter of the core 16. Each roller has a length slightly less than the axial spacing of the cheeks 24 of a spool so that their coplanar end faces fit between the cheeks 24** to hold the spools in axially fixed position.

In order to prevent the cheeks 24 from coming to rest on the shafts **10*a* and 10*b***, the difference D between the roller radius and the shaft radius exceeds the difference *d* between the cheek radius and the core radius whereby the core is engaged by the rollers even when the thread layer 18 has not yet been formed thereon. During the winding operation, this thread layer 18 reposes on the members **12*a* and 12*b* of the associated roller pair. At least one of the rollers of each pair is positively driven, e.g. counterclockwise as viewed in FIG. 1, with resulting clockwise rotation of the spools 14** as indicated by arrows.

The roller drive (see also FIG. 4) comprises a motor 11 having a pulley 13 linked by a belt 15 with a pulley 17 on shaft **10*a*. With the described sense of rotation, the thread 22 passes upwardly to the spool core 16 after traversing a frictional guide, here an eyelet 46, which is reciprocated in step with the spool rotation, as will be explained in more detail with reference to FIG. 4. This movement of eyelet 46** causes the thread to be wound on the core in convolutions close to one another.

If the sense of rotation of the rollers **12*a* and 12*b* and of the spool 14 were reversed, the thread 22 would approach the core 16 with a downward slant as indicated by a dot-dash line in FIG. 1**.

The two shafts **10*a* and 10*b* may be relatively displaceable, as more fully described hereafter, to increase the spacing of the rollers of each pair for letting a finished yarn package 20 drop onto a conveyor belt 44 as shown in FIG. 2. This belt is continuously or intermittently driven to move the packages through a heating tunnel 45** for thermal fixation of the threads on the spools. For this treatment, the spool should consist of a heat-resistant material, preferably sheet steel.

Figure 3:
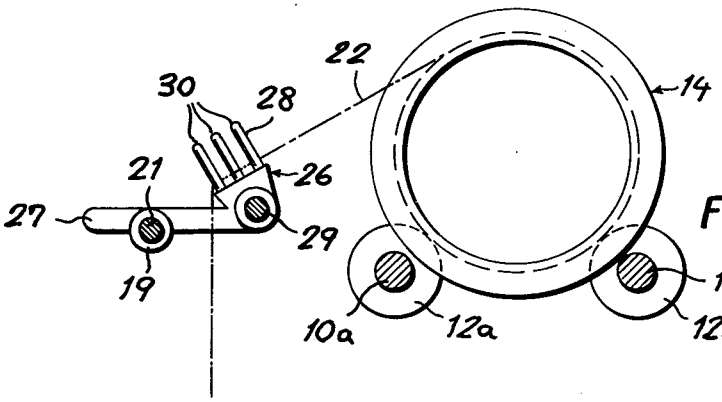
FIG. 3 is an end view of the mechanism of FIG. 1 combined with a thread guide and brake.
Figure 4:
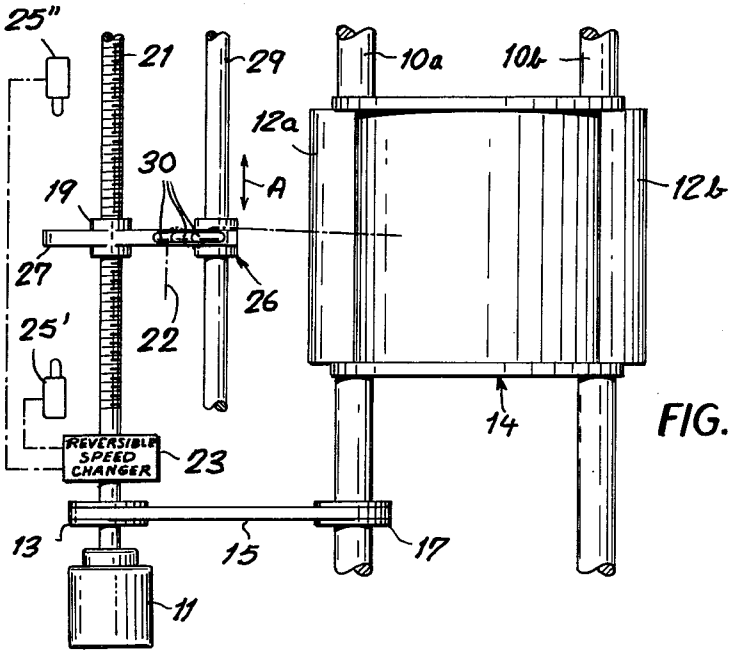
FIG. 4 shows the assembly of FIG. 3 in top view.

FIGS. 3 and 4 illustrate a modified thread guide 26 mounted on a nut 19 of a leadscrew 21 which is driven from motor 11 through the intermediary of a reversible speed changer 23, controlled by two limit switches 25', 25'' that are alternately tripped by a lug 27, to perform a reciprocating motion as indicated by a double-headed arrow A. This thread guide 26, traveling along a stationary rod 29, is equipped with a thread brake in the form of a fork or comb 28 having three thread-diverting tines 30. The thread 22 is led here in a zig-zag manner around the tines which exert sufficient friction to hold the thread taut. The pitch of the thread convolutions may be varied by adjusting the transmission ratio of speed changer 23. This avoids the formation of cross-over points which could produce surface stresses.

Since the diameter of the thread package changes but little during the winding operation, the selected pitch remains nearly constant.

Figure 5:
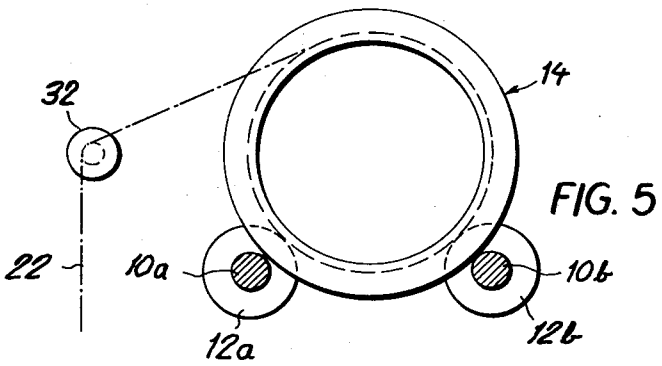
FIG. 5 is a view similar to FIG. 3, showing a modification.
Figure 6:
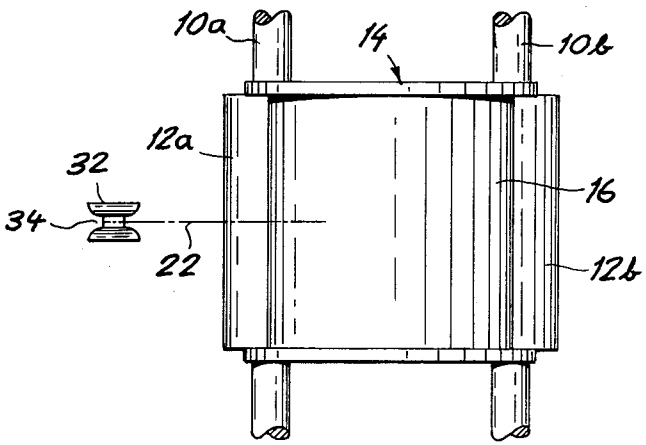
FIG. 6 is a top view of the embodiment illustrated in FIG. 5.

In the embodiment illustrated in FIG. 5 and 6, a reciprocating thread guide is in the form of a nonrotatable roll 32 having a peripheral slot 34 in which the thread 22 is resiliently clamped so as to remain under the necessary tension during the winding process.

Figure 7:
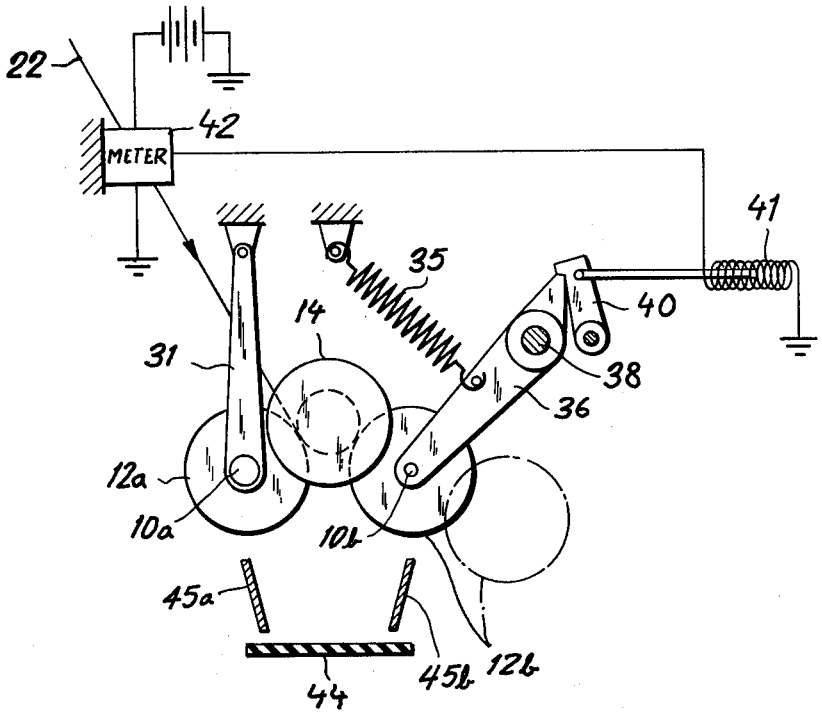
FIG. 7 shows, in end view, a further embodiment of my present invention.
Figure 8:
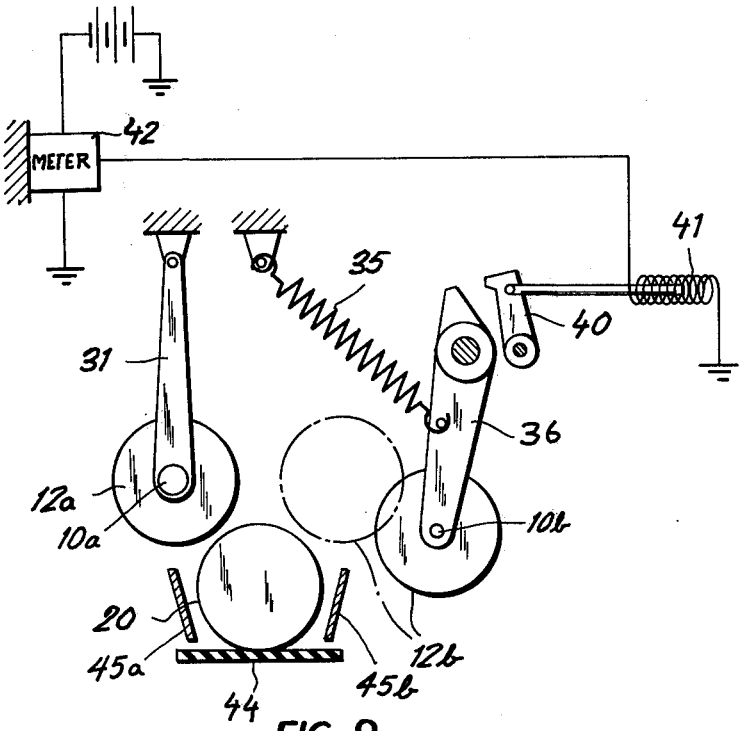
FIG. 8 is a view similar to FIG. 7, showing an alternate position.

FIGS. 7 and 8 show the shaft 10*a* of the driven roller 12*a* journaled in a fixed mounting comprising several parallel arms 31 (only one of them being visible) while the shfat 10*b* for the other roller 12*b* is held by a set of parallel levers 36 swingable about a pivotal axle 38. Thus, the nondriven roller 12*b* has two positions in one of which it supports the spool 14 and in the other of which it allows the spool to drop onto the conveyor 44. A detent 40 is releasably engaged with the illustrated lever 36 to secure the roller 12*b* in its working position until the yarn package 20 has been wound.

Various means may be provided for determining the completion of the packages and controlling the release of the lever 36. Thus, for instance, there may be installed a metering counter 42, shown in FIG. 7, which measures the length of the thread 22 supplied to the spool 14. The detent 40 is retractable by an actuator 41, here shown as a solenoid, whose energizing circuit is closed whenever the counter ascertains that a predetermined length of the thread has passed though.

FIG. 7 also shows a restoring spring 35 arranged to swing the lever 36 back toward the driven roller 12*a* and thus to re-establish the initial minimum distance between this roller and the roller 12*b*. The spring 35 must not be so strong as to prevent the outward swing of the roller 12*b* when the latter is encumbered by a loaded spool 14. Naturally, other means may be provided to restore this spool-supporting position of the rollers 12*a* and 12*b*, e.g. positive-acting devices such as solenoids or pneumatic jacks.

In FIGS. 7 and 8 the conveyor belt 44 is shown flanked by two sidewalls 45*a* and 45*b* serving to guide the packages 20 released from the rollers.

Figure 9:
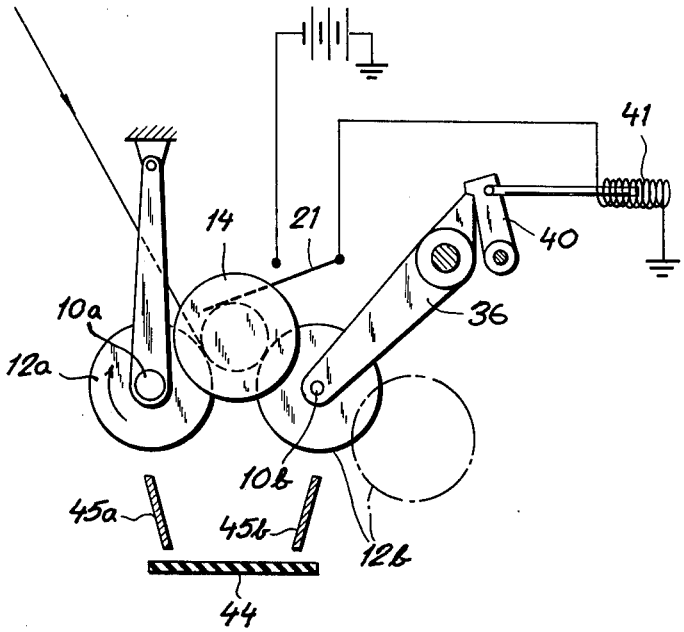
FIG. 9 is a view similar to FIG. 8, showing still another modification.

FIG. 9 shows another type of sensor controlling the release of a loaded spool 14. Here, a switch inserted in the energizing circuit of solenoid 41 has an armature 21 positioned to ride on the thread layer formed on the spool core. Thus, when the body of thread surrounding the spool core reaches a certain thickness, this switch is closed to disengage the detent 40 from the lever 36 whereupon the roller 12*b* yields to the weight of the loaded spool 14, letting it drop onto the conveyor belt 44. Naturally, the swingable mounting 36 for the roller 12*b* may here also be provided with restoring means as described above.

I claim:

1. In a mechanism for winding a filament onto a spool having a core, including a pair of parallel horizontal shafts and rollers on said shafts normally spaced apart by a distance less than the diameter of said core for supporting said spool during loading thereof by the winding of a filament on said core, at least one of said rollers being driven for rotatingly entraining the supported spool, the improvement wherein one of said shafts is provided with a stationary mounting and the other of said shafts is provided with a swingable mounting enabling lateral separation of said rollers from each other under the weight of a loaded spool to let the spool drop between said rollers onto a receiving surface, further comprising detent means engageable with said swingable mounting in a normal position thereof for preventing premature separation of said rollers, release means for deactivating said detent means upon the winding of a predetermined amount of filament on said core, and spring means linked with said swingable mounting for restoring same to said normal position upon the dropping of a loaded spool from said rollers, said spring means acting upon said swingable mounting with a restoring force insufficient to prevent the separation of said rollers by a loaded spool upon the deactivation of said detent means.

2. The improvement defined in claim 1 wherein said release means comprises metering means traversed by said filament for measuring the amount thereof wound on said core and emitting a deactivating signal for said detent means upon said amount reaching a predetermined value.

3. The improvement defined in claim 1 wherein said release means comprises feeler means engaging said spool for sensing the thickness of a filament layer would on said core and emitting a deactivating signal for said detent means upon said thickness reaching a predetermined value.

* * * * *